US009051854B1

(12) United States Patent
Cyborski

(10) Patent No.: US 9,051,854 B1
(45) Date of Patent: Jun. 9, 2015

(54) VALVE TRAIN HYDRAULIC LASH ADJUSTER WITH PARTIAL RECIRCULATION FEATURE

(71) Applicant: Caterpillar Inc., Peoria, IL (US)

(72) Inventor: David Andrew Cyborski, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/196,403

(22) Filed: Mar. 4, 2014

(51) Int. Cl.
*F01L 1/14* (2006.01)
*F01L 1/24* (2006.01)
*F01P 3/12* (2006.01)

(52) U.S. Cl.
CPC *F01L 1/2422* (2013.01); *F01P 3/12* (2013.01)

(58) Field of Classification Search
USPC ..... 123/90.45–90.58
See application file for complete search history.

(56) References Cited

U.S. PATENT DOCUMENTS

| | | | | |
|---|---|---|---|---|
| 2,812,750 | A * | 11/1957 | Lesher | 123/90.55 |
| 4,184,464 | A | 1/1980 | Svihlik | |
| 5,216,988 | A * | 6/1993 | Taxon | 123/90.12 |
| 5,862,785 | A | 1/1999 | Blowers et al. | |
| 7,921,823 | B2 | 4/2011 | Sailer et al. | |
| 8,001,941 | B2 * | 8/2011 | Fujii et al. | 123/90.52 |
| 2012/0325171 | A1 | 12/2012 | Langewisch et al. | |

FOREIGN PATENT DOCUMENTS

| | | |
|---|---|---|
| JP | 8158821 | 6/1996 |

* cited by examiner

*Primary Examiner* — Hung Q Nguyen
(74) *Attorney, Agent, or Firm* — Liell & McNeil Attorneys, PC; Baker Hostetler

(57) ABSTRACT

A hydraulic lash adjuster for a valve train of an internal combustion engine uses a partial recirculation feature in order to provide device cooling while also retaining many of the benefits associated with leak recirculation. The hydraulic lash adjuster includes a hollow piston that is received in an axial bore of a body component. The annular clearance area between the hollow piston and the body defines a plurality of leak escape paths and a plurality of leak recirculation paths. The portion of the leaked oil recirculated is on a same order of magnitude as the remaining portion of the leaked oil that is allowed to escape back to sump.

20 Claims, 2 Drawing Sheets

VALVE TRAIN HYDRAULIC LASH ADJUSTER WITH PARTIAL RECIRCULATION FEATURE

TECHNICAL FIELD

The present disclosure relates generally to hydraulic lash adjusters for valve trains in internal combustion engines, and more particularly to a partial recirculation feature of leaked oil for cooling the hydraulic lash adjuster.

BACKGROUND

Hydraulic lash adjusters are well known devices for use in valve trains for maintaining near zero valve clearance in an internal combustion engine. The hydraulic lash adjusters are typically situated between the camshaft and each of the engine's gas exchange valves. The lash adjuster comprises a hollow steel cylinder that encases an internal piston. The piston is biased toward its outer limit to lengthen the hydraulic lash adjuster with a spring. Together, the cylinder and the piston define a fluid chamber filled with oil. When the gas exchange valve is closed, the fluid chamber is free to refill with oil. As the camshaft lobe enters the lift phase of its travel, the hydraulic lash adjuster is compressed and an oil inlet valve is closed. Because oil is nearly incompressible, the compression renders the lash adjuster effectively solid during the lift phase. However, because some clearance must be maintained between the piston and the cylinder of the hydraulic lash adjuster, some oil will leak along this annular clearance during each cycle. As the camshaft lobe travels through its peak, the load is reduced on the lifter piston, and the internal spring returns the piston to its neutral state so that the fluid chamber can refill with oil.

U.S. Pat. No. 4,184,464 shows a hydraulic lash adjuster that shows a capture groove defined in the outer surface of the piston so that leaked hydraulic fluid during the compression phase can be captured and recirculated within the hydraulic lash adjuster. Hydraulic lash adjusters that predated the '464 patent typically included no recapture or recirculation groove so that all of the leaked oil would spill from the hydraulic lash adjuster and be returned to sump. In some newer applications, neither full recirculation nor zero recirculation hydraulic lash adjusters addressed new potential problems in these engines.

The present disclosure is directed toward one or more of the problems set forth above.

SUMMARY

A hydraulic lash adjuster includes a body with an inner surface that defines an axial bore. A hollow piston is telescopically received in the axial bore and includes an external surface. The body and the hollow piston define a low pressure chamber separated from a high pressure chamber by a valve seat. A valve member is positioned in the high pressure chamber and is moveable between a closed position in contact with the valve seat, and an open position out of contact with the valve seat. A leak passage is defined by an annular clearance area between the inner surface of the body and the external surface of the hollow piston. The leak passage includes a plurality of leak escape paths and a plurality of leak recirculation paths. Each of the leak escape paths extend a length from the high pressure chamber to an exit from the annular clearance and has a width corresponding to a first angular segment of the annular clearance. Each of the leak recirculation paths extends from the high pressure chamber to a groove defined by the external surface of the hollow piston. The groove extends a second angular segment of the annular clearance. An angular sum of the first angular segments are on a same order of magnitude as an angular sum of the second angular segments. The angular sum of the first angular segments plus the sum of the second angular segments equals 360 degrees. A plurality of recirculation ports are defined by the hollow piston, and each of the recirculation ports extends between one of the grooves and the low pressure chamber.

In another aspect, a valve train includes a camshaft with an intake cam and an exhaust cam. An intake valve is operably coupled to a first valve bridge, and an exhaust valve is operably coupled to a second valve bridge. A first push rod extends between the intake cam and the first valve bridge, and a second push rod extends between the exhaust cam and the second valve bridge. Each of the first and second push rods includes a hydraulic lash adjuster according to the present disclosure.

In still another aspect, a method of operating a valve train includes opening a gas exchange valve responsive to rotation of a camshaft. The gas exchange valve is closed responsive to rotation of the camshaft. The opening step includes coupling a valve stem to the camshaft with a hydraulic lash adjuster. The length of the hydraulic lash adjuster is adjusted. The hydraulic lash adjuster is cooled by recirculating a first portion of oil leaked from a high pressure chamber, and escaping a remaining portion of the oil leaked from the high pressure chamber responsive to the opening step. The cooling step includes moving fresh oil into the hydraulic lash adjuster responsive to the step of closing the gas exchange valve. The first portion and the remaining portion of the leaked oil are of a same order of magnitude.

DETAILED DESCRIPTION

Figure 1:
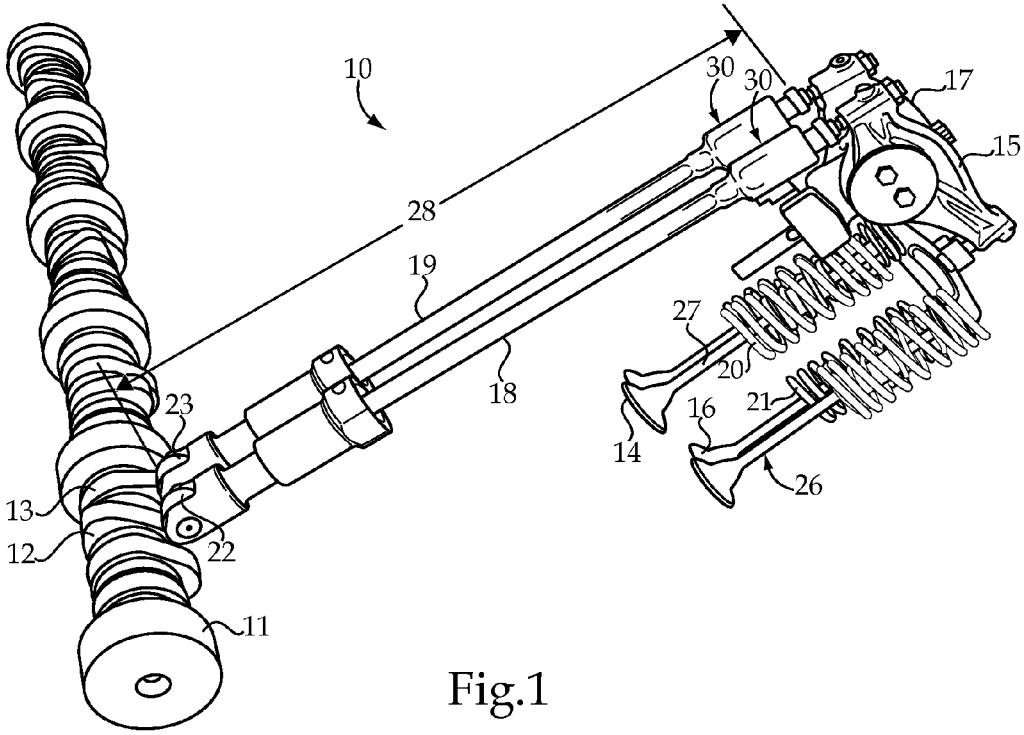
FIG. 1 is a perspective view of a valve train according to the present disclosure.

Referring to FIG. 1, a valve train 10 and its associated gas exchange valves 26 for a single engine cylinder are shown apart from the engine block and head, within which the valve train 10 is mounted. Valve train 10 includes a rotating camshaft 11 with an intake cam 12 and an exhaust cam 13. An intake valve 14 is operably coupled to a first valve bridge 15, and an exhaust valve 16 is operably coupled to a second valve bridge 17 in a conventional manner. A first push rod 18 extends between the intake cam 11 and the first valve bridge 15. A second push rod 19 extends between the exhaust cam 13 and the second valve bridge 17. Intake valve 14 is biased toward a closed position by a first return spring 20, and the exhaust valve 16 is biased toward a closed position with a second return spring 21. Each of the push rods 18 and 19 include a rotating cam follower 22 and 23, respectively, that roll on the outer surface of respective cams 12 and 13 when the engine (not shown) is in operation. Each of the push rods 18 and 19 include a hydraulic lash adjuster 30 that allows the lengths 28 of pushrods 18 and 19 to slightly adjust to remove gaps in the linkage between the rotating cams 12, 13 and the respective gas exchange valves 26. The illustration shows two intake valves 14 and two exhaust valves 16. Those skilled in the art will appreciate that the present disclosure could also apply to engines with overhead cams in which the push rods 18 and 19 are eliminated but a hydraulic lash adjuster is still included, without departing from the intended scope of the present disclosure.

Figure 2:
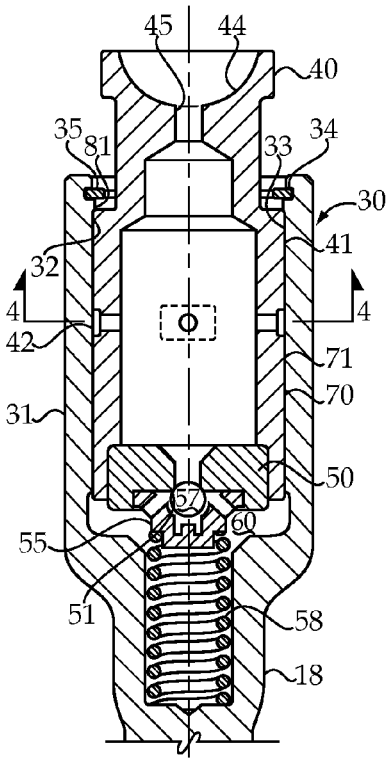
FIG. 2 is a front sectioned view of a hydraulic lash adjuster according to an aspect of the present disclosure.

Referring now in addition to FIG. 2, hydraulic lash adjuster 30 includes a body 31, which is a portion of push rod 18 (or 19), with an inner surface 32 that defines an axial bore 33. A hollow piston 40 is telescopically received within axial bore 33. Hollow piston 40 may be trapped in axial bore 33 by body 30 including a groove 34 with a snap ring 35 mounted therein. In addition to hollow piston 40, a valve body 50, a valve cage 55, a valve member 57 and a spring 58 are all positioned within axial bore 33. Depending upon design considerations, valve body 50 can be manufactured as a portion of hollow piston 40, or may appear as a separate component attached thereto, as shown. The body 30 and the hollow piston 40 define a low pressure chamber 46 fluidly separated from a high pressure chamber 60 by a valve seat 51. Valve member 57, which may be spherical, is positioned in the high pressure chamber 60 and is movable between a closed position in contact with valve seat 51, and an open position out of contact with valve seat 51. A leak passage 70 is defined by an annular clearance area 71 between the inner surface 32 of body 31 and an external surface 41 of hollow piston 40. Leak passage 70 is fluidly connected to low pressure chamber 46 by a plurality of grooves 42 defined by the external surface 41 of hollow piston 40. A plurality of recirculation ports 43, which are defined by hollow piston 40, extend between the grooves 42 and the low pressure chamber 46. In the specific embodiment, hollow piston 40 defines exactly four recirculation ports 43 respectively opening through exactly four grooves 42. Nevertheless, those skilled in the art will appreciate that there need not necessarily be equal numbers of recirculation ports and grooves in order to fall within the scope of the present disclosure. In addition, more than four or less than four grooves and recirculation ports could also fall within the intended scope of the present disclosure. Hollow piston 40 may include a concave contact surface 44 where push rod 18 contacts valve bridge 15, but other surface structures could also fall within the intended scope of the present disclosure. An oil feed port 45 is defined by hollow piston 40 and extends through the concave contact surface 44 to the low pressure chamber 46. The oil feed port 45 serves as the pathway for supplying fresh lubricating oil to hydraulic lash adjuster 30 during normal engine operation. A relatively strong spring 58 is operably positioned in the high pressure chamber 60 to bias hollow piston 40 away from body 30 in a conventional manner.

The present disclosure teaches a solution to a problem that has previously gone unrecognized in the art. In particular, many hydraulic lash adjusters of the past included an annular groove on the external surface of the hollow piston along with one or more recirculation ports (see background reference U.S. Pat. No. 4,184,464) to capture and recirculate virtually all of the oil that moves from high pressure chamber upward along leak path passage and recirculates substantially all of the leaked oil back to low pressure chamber. Under these circumstances, temperatures within the hydraulic lash adjuster can become high due to the amount of work being done by the small amount of oil in the hydraulic lash adjuster. When these temperatures become sufficiently elevated, problems with oil varnishing can occur, which can lead to the hydraulic lash adjuster piston sticking, which in turn can potentially lead to gas exchange valve and seat failures. The present disclosure solves this problem by recirculating some of the leaked oil in the leak passage 70, and allowing a remaining fraction of the leaked oil in the leak passage 70 to escape at exit 81 from the annular clearance area 71 to eventually return to the engine's oil sump for recirculation. This escaped higher temperature oil is made up by fresh cooler oil fed to low pressure chamber 46 through oil feed port 45. In all cases of the present disclosure, the leaked oil that is recirculated to the low pressure chamber 46 is of a same order of magnitude as the leaked oil that is allowed to escape. As used in the present disclosure, of the same order of magnitude means that neither of the leaked escape amount nor the leaked recirculation amount is more than ten times the other. In other words, the recirculated leaked oil is less than ten times the escaped leaked oil, and vice versa.

Figure 4:
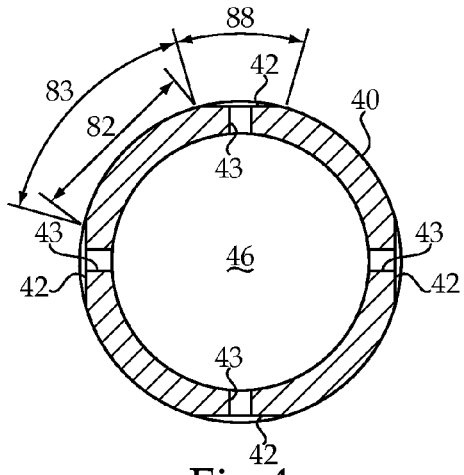
FIG. 4 is a top sectioned view of the hollow piston for the hydraulic lash adjuster of FIG. 2.
Figure 7:
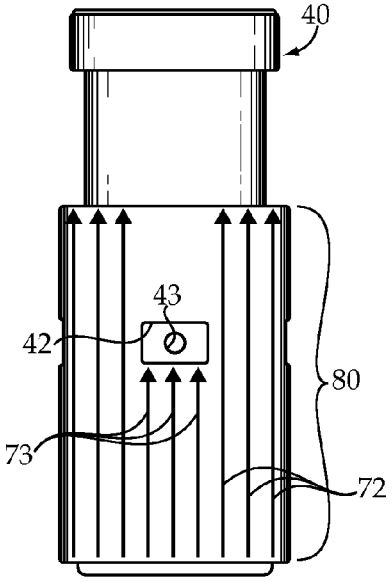
FIG. 7 is a front view of the hollow piston from the hydraulic lash adjuster of FIG. 2 showing the leak escape paths and the leak recirculation paths according to the present disclosure.

Referring now in addition to FIGS. 4 and 7, the partial leak recirculation strategy of the present disclosure is accomplished by dividing the circumference of the external surface 41 of hollow piston 40 into different angular segments that are either devoted to being leak escape paths 72 or leak recirculation paths 73. The leak passage 70, which is defined by the annular clearance area 71 between the inner surface 32 of body 30 and the external surface 41 of hollow piston 40 includes a plurality of leak escape paths 72 and a plurality of leak recirculation paths 73. Each of the leak escape paths 72 extends a length 80 from the high pressure chamber 60 to the exit 81 from the annular clearance area 71, and has a width 82 corresponding to a first angular segment 83 of the annular clearance area 71. Each of the leak recirculation paths 73 extends from the high pressure chamber 60 to one groove 42 of the plurality of grooves defined by the external surface 41 of hollow piston 40. Each of the grooves 42 extends a second angular segment 88 of the annular clearance area 71. The relative proportions of leaked recirculation oil to leaked escape oil are defined by the magnitude of the angular segments 83 and 88 that make up the respective leak escape paths 72 and leak recirculation paths 73, respectively. An angular sum of the first angular segments 83 is on the same order of magnitude as an angular sum of the second angular segments 88. In other words, neither angular sum is more than ten times the other angular sum. Inherently, the angular sum of the first angular segments 83 plus the sum of the second angular segments 88 equals a full 360 degree circumference of the annular clearance area 71. In the example embodiment of the disclosure shown FIGS. 2, 4 and 7, the angular sum of the first angular segments 83, which corresponds to the leak escape paths 72, is about double the angular sum of the second angular segments 88, which correspond to the leak recirculation paths 73. As used in this disclosure, the term "about double" means that the ratio of the two numbers rounded to a single significant digit is two. An angular sum of 220 degrees is about double and angular sum of 140 degrees. However, an angular sum of 200 degrees is not about double an angular sum of 160 degrees.

Figure 3:
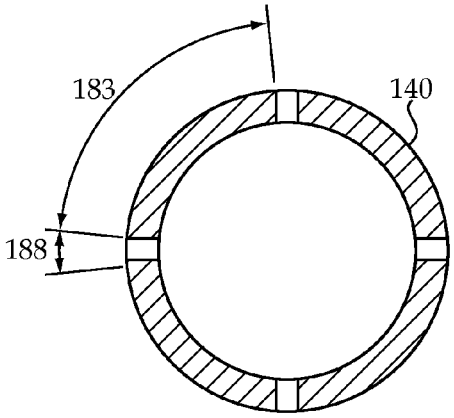
FIG. 3 is a top sectioned view of a hollow piston for a hydraulic lash adjuster according to another aspect of the present disclosure.
Figure 5:
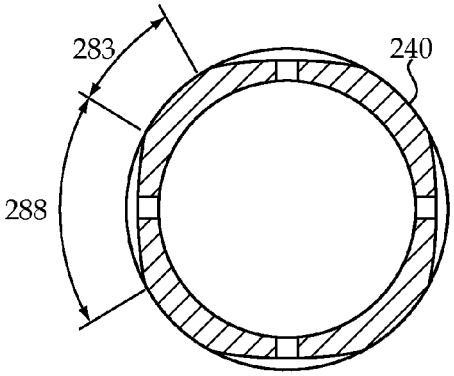
FIG. 5 is a top sectioned view of a hollow piston for a hydraulic lash adjuster according to another aspect of the present disclosure.
Figure 6:
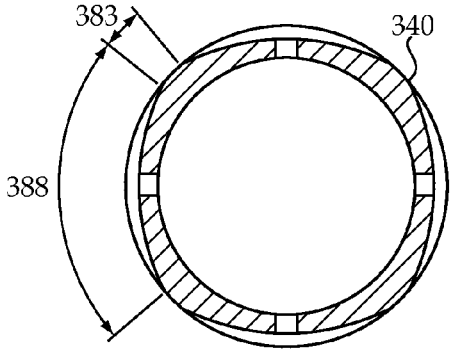
FIG. 6 is a top sectioned view of a hollow piston for a hydraulic lash adjuster according to still another aspect of the present disclosure.

FIGS. 3 and 6 show extreme versions of the present disclosure. In particular, FIG. 3 shows a sectioned view through a hollow piston 140 in which the first angular segment 183, corresponding to the leak escape path is ten times the size of the second angular segment 188 corresponding to the leak recirculation path. FIG. 6 shows an inverse extreme in which a hollow piston 340 includes four leak escape paths that each have a first angular segment 383 that is one tenth the size of the second angular segment 388, corresponding to the leak recirculation path 73. FIG. 5 shows the inverse of FIG. 4. In particular, a hollow piston 240 includes the second angular segments 288, which correspond to the leak recirculation path that are about double the first angular segment 283, which corresponds to the leak escape path.

Those skilled in the art will appreciate that the relative sizes of the leak recirculation paths 73 to the leak escape paths 72 might be different or similar for different engine applications. On the other hand, an engine manufacturer that makes a line of different engines may select a ratio of leak recirculation to leak escape for the engine experiencing the highest hydraulic lash adjuster temperatures, and then make the hollow pistons for the other engines the same in order to reduce part count.

INDUSTRIAL APPLICABILITY

The present disclosure finds potential application in any engine that utilizes hydraulic lash adjusters in valve trains. The present disclosure finds specific applicability to hydraulic lash adjusters for engines in which the hydraulic lash adjusters experience elevated temperatures that could be sufficiently severe that the oil is altered by the high temperatures leading to the hollow pistons sticking rather then reciprocating in the push rod body. Hydraulic lash adjuster sticking can then lead to gas exchange valve failures and accelerated wear at the respective valve seats.

Referring again to FIGS. 1, 2, 4 and 7, a method of operating valve train 10 includes rotating camshaft 11. Each gas exchange valve 26 opens and closes responsive to rotation of camshaft 11 in a manner well known in the art. In a typical manner, the opening of the gas exchange valve 26 is accomplished by coupling a valve stem 27 to camshaft 11 with a hydraulic lash adjuster 30. Inherently, a length 28 of the hydraulic lash adjuster 30 adjusts to accommodate variations in and changes to the geometry of valve train 10. The hydraulic lash adjuster 30 is cooled by recirculating a first portion of oil leaked from high pressure chamber 60, and escaping a remaining portion of the oil leaked from the high pressure chamber responsive to the opening of the gas exchange valve 26 when the cam lobe rotates through and pressure in high pressure chamber 60 is highest. After the cam lobe moves through, during the closing of the gas exchange valve 26, the cooling of the hydraulic lash adjuster includes moving fresh oil into the low pressure chamber 46 through the oil feed port 45. The escaped leaked oil is returned to sump. The recirculated leaked oil and the escaped leak oil are of a same order of magnitude, which is defined by the external geometry of the hollow piston 40 as described earlier. Although likely more difficult to manufacture, one could relocate the grooves 42 of the present disclosure to the inner surface 32 of body 31 without departing from the intended scope of the present disclosure. Those skilled in the art will appreciate that the recirculated leaked oil is moved into the grooves 42 defined, in the illustrated embodiment, by the outer surface 41 of hollow piston 40. The escaped leak oil moves between the grooves in a clearance between the body 30 and the hollow piston 40. Those skilled in the art will appreciate that with each rotation cycle of camshaft 31 and each corresponding reciprocation cycle of hydraulic lash adjuster 30, oil is moved from low pressure chamber 46 into high pressure chamber 60 when the pressures in the two chambers equalize after the cam lobe has moved to close the gas exchange valve 26. This step of moving oil from the low pressure chamber 46 to the high pressure chamber 60 occurs by opening the oil valve 52 responsive to the spring 58 biasing the hollow piston 40 away from body 30 in order to take up the lash in the linkage between camshaft 31 and the valve seat for the respective gas exchange valve 26. Oil valve 52 is closed responsive to compression of the hydraulic lash adjuster 30 during the step of opening the gas exchange valve 26 in a conventional manner.

Apart from arriving at a leak escape fraction that sufficiently cools the hydraulic lash adjuster 34 in a given application, there is also a consideration of recirculating as much oil as possible in order to place less demand on the overall lubrication circuit for the engine. In addition, recirculating more oil allows the hydraulic lash adjuster to operate longer if for some reason the engine's oil pump were to fail or oil flow to the hydraulic lash adjuster were somehow restricted or blocked for whatever reason. Thus, each engine may require different weighing of these considerations to allow for a range of different proportions of leaked recirculation oil to leaked escape oil for different specific engine applications.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A hydraulic lash adjuster comprising:

a body with an inner surface that defines an axial bore;

a hollow piston telescopically received within the axial bore and including an external surface;

the body and the hollow piston defining a low pressure chamber separated from a high pressure chamber by a valve seat;

a valve member positioned in the high pressure chamber and being movable between a closed position in contact with the valve seat, and an open position out of contact with the valve seat;

a leak passage being defined by an annular clearance area between the inner surface of the body and the external surface of the hollow piston;

the leak passage including a plurality of leak escape paths and a plurality of leak recirculation paths;

each of the leak escape paths extending a length from the high pressure chamber to an exit from the annular clearance and having a width corresponding to first angular segment of the annular clearance;

each of the leak recirculation paths extending from the high pressure chamber to one groove of a plurality of grooves defined by the external surface of the hollow piston, and the plurality of grooves extends a second angular segment of the annular clearance;

an angular sum of the first angular segments being a same order of magnitude as an angular sum of the second angular segments, and the angular sum of the first angular segments plus the sum of the second angular segments equals 360 degrees; and a plurality of recirculation ports defined by the hollow piston, and each of the recirculation ports extending between one of the grooves and the low pressure chamber.

2. The hydraulic lash adjuster of claim 1 wherein the hollow piston includes a concave contact surface for contacting a valve bridge; and the hollow piston defining an oil feed port extending through the concave contact surface to the low pressure chamber.

3. The hydraulic lash adjuster of claim 2 wherein the angular sum of one of the first angular segments and the second angular segments is about double the angular sum of the other of the first angular segments and the second angular segments.

4. The hydraulic lash adjuster of claim 2 wherein the hollow piston defines exactly four recirculation ports and exactly four grooves.

5. The hydraulic lash adjuster of claim 2 including a spring operably positioned in the high pressure chamber to bias the hollow piston away from the body.

6. The hydraulic lash adjuster of claim 2 wherein the body is a portion of a pushrod.

7. The hydraulic lash adjuster of claim 2 wherein the angular sum of one of the first angular segments and the second angular segments is about double the angular sum of the other of the first angular segments and the second angular segments;

the hollow piston defines exactly four recirculation ports and exactly four grooves;

a spring operably positioned in the high pressure chamber to bias the hollow piston away from the body;

the body is a portion of a pushrod.

8. A valve train comprising:

a cam shaft with an intake cam and an exhaust cam;

an intake valve operably coupled to a first valve bridge;

an exhaust valve operably coupled to a second valve bridge;

a first pushrod extending between the intake cam and the first valve bridge;

a second pushrod extending between the exhaust cam and the second valve bridge;

each of the first and second pushrods including a hydraulic lash adjuster that includes:

a body with an inner surface that defines an axial bore;

a hollow piston telescopically received within the axial bore and including an external surface;

the body and the hollow piston defining a low pressure chamber separated from a high pressure chamber by a valve seat;

a valve member positioned in the high pressure chamber and being movable between a closed position in contact with the valve seat, and an open position out of contact with the valve seat;

a leak passage being defined by an annular clearance area between the inner surface of the body and the external surface of the hollow piston;

the leak passage including a plurality of leak escape paths and a plurality of leak recirculation paths;

each of the leak escape paths extending a length from the high pressure chamber to an exit from the annular clearance and having a width corresponding to first angular segment of the annular clearance;

each of the leak recirculation paths extending from the high pressure chamber to one groove of a plurality of grooves defined by the external surface of the hollow piston, and the plurality of grooves extends a second angular segment of the annular clearance;

an angular sum of the first angular segments being on a same order as an angular sum of the second angular segments, and the angular sum of the first angular segments plus the sum of the second angular segments equals 360 degrees; and a plurality of recirculation ports defined by the hollow piston, and each of the recirculation ports extending between one of the grooves and the low pressure chamber.

9. The valve train of claim 8 wherein the hollow piston includes a concave contact surface for contacting a valve bridge; and the hollow piston defining an oil feed port extending through the concave contact surface to the low pressure chamber.

10. The valve train of claim 9 wherein the angular sum of one of the first angular segments and the second angular segments is about double the angular sum of the other of the first angular segments and the second angular segments.

11. The valve train of claim 9 wherein the hollow piston defines exactly four recirculation ports and exactly four grooves.

12. The valve train of claim 9 including a spring operably positioned in the high pressure chamber to bias the hollow piston away from the body.

13. The valve train of claim 9 wherein the body is a portion of a pushrod.

14. The valve train of claim 9 wherein the angular sum of one of the first angular segments and the second angular segments is about double the angular sum of the other of the first angular segments and the second angular segments;

the hollow piston defines exactly four recirculation ports and exactly four grooves;

a spring operably positioned in the high pressure chamber to bias the hollow piston away from the body.

15. A method of operating a valve train comprising the steps of:

opening a gas exchange valve responsive to rotation of a cam shaft;

closing the gas exchange valve responsive to rotation of the cam shaft;

the opening step includes coupling a valve stem to the cam shaft with a hydraulic lash adjuster;

adjusting a length of the hydraulic lash adjuster;

cooling the hydraulic lash adjuster by recirculating a first portion of oil leaked from a high pressure chamber and escaping a remaining portion of the oil leaked from the high pressure chamber responsive to the opening step;

the cooling step includes moving fresh oil into the hydraulic lash adjuster responsive to the closing step; and the first portion and the remaining portion are of a same order of magnitude.

16. The method of claim 15 wherein the hydraulic lash adjuster includes a hollow piston received in an axial bore of a body;

the recirculating step includes moving leaked oil into grooves defined by an outer surface of the hollow piston; and the escaping step includes moving oil between the grooves in a clearance between the body and the hollow piston.

17. The method of claim 16 wherein the cooling step includes moving oil from a low pressure chamber into the high pressure chamber responsive to the closing step.

18. The method of claim 17 wherein one of the first portion and the remaining portion is about double an other of the first portion and the remaining portion.

19. The method of claim 18 including a step of opening an oil valve fluidly separating the high pressure chamber from the low pressure chamber responsive to a spring operably positioned to bias the hollow piston away from the body.

20. The method of claim 19 including a step of closing the oil valve responsive to compression of the hydraulic lash adjuster during the step of opening the gas exchange valve.

* * * * *